United States Patent [19]

Maisonneuve et al.

[11] 3,967,396

[45] July 6, 1976

[54] UNDERCUTTER WITH ROTARY TRENCHER

[75] Inventors: Hubert Maisonneuve, West Columbia; Helmuth von Beckmann, Columbia; Joseph C. Sun, Lexington, all of S.C.

[73] Assignee: Canron, Inc., New York, N.Y.

[22] Filed: Sept. 23, 1974

[21] Appl. No.: 508,169

[52] U.S. Cl. ..... 37/104; 37/80 A; 37/94; 37/97; 37/190; 104/2; 171/16

[51] Int. Cl.[2] ..... E01B 27/04; E02F 5/08; E02F 5/18

[58] Field of Search ..... 37/195, 104, 97, 94, 37/91, 95, 80 R, 189, 80 A, 190, 191 R, 191 A, 192 R, 192 A; 171/16; 74/465; 104/2

[56] References Cited

UNITED STATES PATENTS

| | | | |
|---|---|---|---|
| 477,292 | 6/1892 | Bradley | 74/465 X |
| 860,536 | 7/1907 | Ellingham | 74/465 X |
| 1,455,206 | 5/1923 | Howe et al. | 37/97 |
| 1,455,608 | 5/1923 | Duder | 37/97 |
| 1,778,690 | 10/1930 | Scheuchzer | 37/104 |
| 1,815,950 | 7/1931 | McWilliams | 37/104 |
| 2,196,880 | 4/1940 | Van Voorhis et al. | 171/16 |
| 2,284,035 | 5/1942 | Blair | 171/16 |
| 2,552,649 | 5/1951 | Protzeller | 37/104 |
| 2,578,058 | 12/1951 | Graham et al. | 37/97 |
| 2,886,904 | 5/1959 | Kershaw | 37/104 |
| 2,896,342 | 7/1959 | Reising | 37/97 |
| 2,897,986 | 8/1959 | Davis | 37/103 UX |
| 2,899,759 | 8/1959 | Campbell | 37/104 |
| 2,921,636 | 1/1960 | Andres et al. | 171/16 |
| 2,995,844 | 8/1961 | Askue | 37/97 |
| 3,146,539 | 9/1964 | Speno et al. | 37/104 |
| 3,356,157 | 12/1967 | Plasser et al. | 171/16 |
| 3,436,848 | 4/1969 | Peppin et al. | 37/104 |

FOREIGN PATENTS OR APPLICATIONS

| | | | |
|---|---|---|---|
| 630,833 | 7/1963 | Belgium | 37/104 |
| 1,373,380 | 12/1964 | France | 37/104 |
| 1,157,636 | 11/1963 | Germany | 37/104 |
| 124,961 | 3/1959 | U.S.S.R. | 37/104 |

*Primary Examiner*—Edgar S. Burr
*Assistant Examiner*—Steven A. Bratlie

[57] ABSTRACT

An undercutting apparatus and a method for removing material from beneath railroad track. The apparatus comprises a rotary trench digging means and horizontal chain means to transport the material from beneath the railroad track to the trench digging means at an underground location. In operation the trench digging means digs a trench alongside of the track while at the same time transporting the material delivered by the horizontal chain means to a suitable location above the ground. Preferably the rotary trench digging means comprises a large hollow wheel and one end of the chain means is disposed inside of and near the bottom of the wheel during normal operation of the chain means. Means are provided to pivot the chain means about a vertical axis whereby the chain means can be pivoted from a first position wherein the chain means extends parallel to the track to a second position wherein the chain means extends perpendicular to the track. The chain means is disposed outside of the wheel in the first position and one end of the chain means is disposed inside of the wheel in the second position.

21 Claims, 10 Drawing Figures

UNDERCUTTER WITH ROTARY TRENCHER

This invention relates to railroad track undercutters and methods used to remove ballast and other material from beneath the ties of the track, and in particular relates to an undercutter employing a rotary trencher.

BACKGROUND OF THE INVENTION

Often it becomes necessary to replace the existing ballast for a railroad track with fresh ballast such as when the old ballast becomes dirty or contaminated with foreign material or breaks down. Alternatively it may be necessary to remove the ballast in order to carry not necessary repairs to the track itself. Because of the network formed by the ties and rails of the track, it is difficult to remove such material with standard, commonly used earth or rock digging equipment.

Methods and machines have been proposed or used in the past which remove the ballast and other material from beneath the railroad ties, the machines sometimes being termed undercutters. Such machines generally employ a toothed chain which moves about an elongated horizontal chain track extending in a direction parallel to the ties of the track. The chain on the chain track is placed beneath the ties and as it operates it scarifies the ballast and pulls the ballast and any material mixed with it to one side of the bed of the railroad track. However present undercutter machines have proved unsatisfactory for track repair work in some areas and have a number of major disadvantages. First of all many undercutters presently in use can only be used where the railroad track and road bed are located above the surrounding ground level either by means of a ditch formed on each side of the track or by placing the roadbed on a built-up bank or ridge of suitable fill material. This limitation is due to the fact that the chain and chain track can only transport the ballast horizontally and therefore there must be an area beside the track into which one end of the chain means can extend and to which the chain means can transport the ballast.

Another problem with the prior art machines is that an unnecessarily large amount of the roadbed may have to be undercut in order for these machines to operate. For example, it may only be necessary to replace the ballast immediately between and underneath the ties of the track. The undercutter on the other hand will remove all the ballast from the side of the roadbed as well as the ballast around the ties because of the need for the undercutter to extend horizontally right out to the ditch or low area beside the roadbed. Thus considerable energy, time and material may be wasted.

In order for prior art undercutters to undercut track laid on a roadbed which is level with the surrounding ground and beside which there is no ditch, it may be necessary for a separate ditch digging machine to precede the undercutter and to form the necessary ditch alongside of the track. Alternatively it is necessary to provide means for transporting the ballast vertically from the delivery end of the chain means to a suitable location above the ground. In order to place the chain means beneath such a railroad track so that it can commence operation, a trench is dug alongside the track parallel thereto. In the past this has sometimes been done by difficult, time-consuming manual labour since it is not worthwhile to bring in a power digger just for this initial ditch. The chain means is then swung 90 degrees about a vertical axis to place it beneath the track.

Accordingly it is an object of the present invention to provide an apparatus and method for removing material from beneath railroad track which substantially overcomes the abovementioned disadvantages and problems with previously known undercutters.

It is another object of the apparatus of the present invention to provide suitable means for transporting ballast and other material delivered from beneath railroad track by horizontal chain means to a suitable location above the ground, the transporting means taking the form of rotary trench digging means. The apparatus is particularly suited for undercutting track at crossings, switches and weak spots which may form in the roadbed.

It is a further object of the present apparatus to provide suitable power means for digging an initial trench alongside of the track for the inseration of the horizontal chain means so that it can be swung to its operating position, the power means being the aforesaid trench digging means which also acts as the vertical transporting means.

SUMMARY OF THE INVENTION

Accordingly the apparatus of the present invention for removing material from beneath railroad track comprises a rotary trench digging means including a large hollow wheel arranged to rotate about a horizontal axis and having digging buckets arranged about the circumference of said wheel, and horizontally extending, elongated chain means to transport said material horizontally, said chain means during normal operation having one end located adjacent the bottom of said wheel and in the interior of said wheel, wherein said material is transported by said chain means from beneath said railroad track to said trench digging means at a point below ground level and beside said railroad track and drops by force of gravity into said digging buckets as said buckets pass beneath said one end of said chain means and whereby in operation said trench digging means digs a trench alongside of said track while at the same time transporting the material delivered by said chain means to a position above the ground level.

Means are provided to pivot the chain means about a vertical axis whereby the chain means can be pivoted from a first position wherein the chain means extends parallel to the track to a second position wherein the chain means extends perpendicular to the track. The chain means is disposed outside of the wheel in the first position and one end of the chain means is disposed inside of the wheel in the second position.

According to the present invention, a method for removing material from beneath railroad track comprises initially digging a trench along one side of said track with rotary trench digging means disposed in a vertical plane, lowering horizontal chain means into said trench, said chain means extending in a direction parallel to said track, swinging said chain means about a vertical axis to an operating position substantially perpendicular to the longitudinal direction of said track and beneath said track and locating one end of said chain means above the bottom of and in the interior of said trench digging means, removing said material from beneath said track with said chain means to said bottom of said trench digging means where said material drops by force of gravity into buckets of said trench digging means, and transporting the material in said buckets to a position above ground with said trench digging means.

BRIEF DESCRIPTION OF THE DRAWINGS

A preferred embodiment of the present invention will now be described by way of example, with reference to the accompanying drawings wherein.

DETAILED DESCRIPTION OF PREFERRED EMBODIMENT

Figure 1:
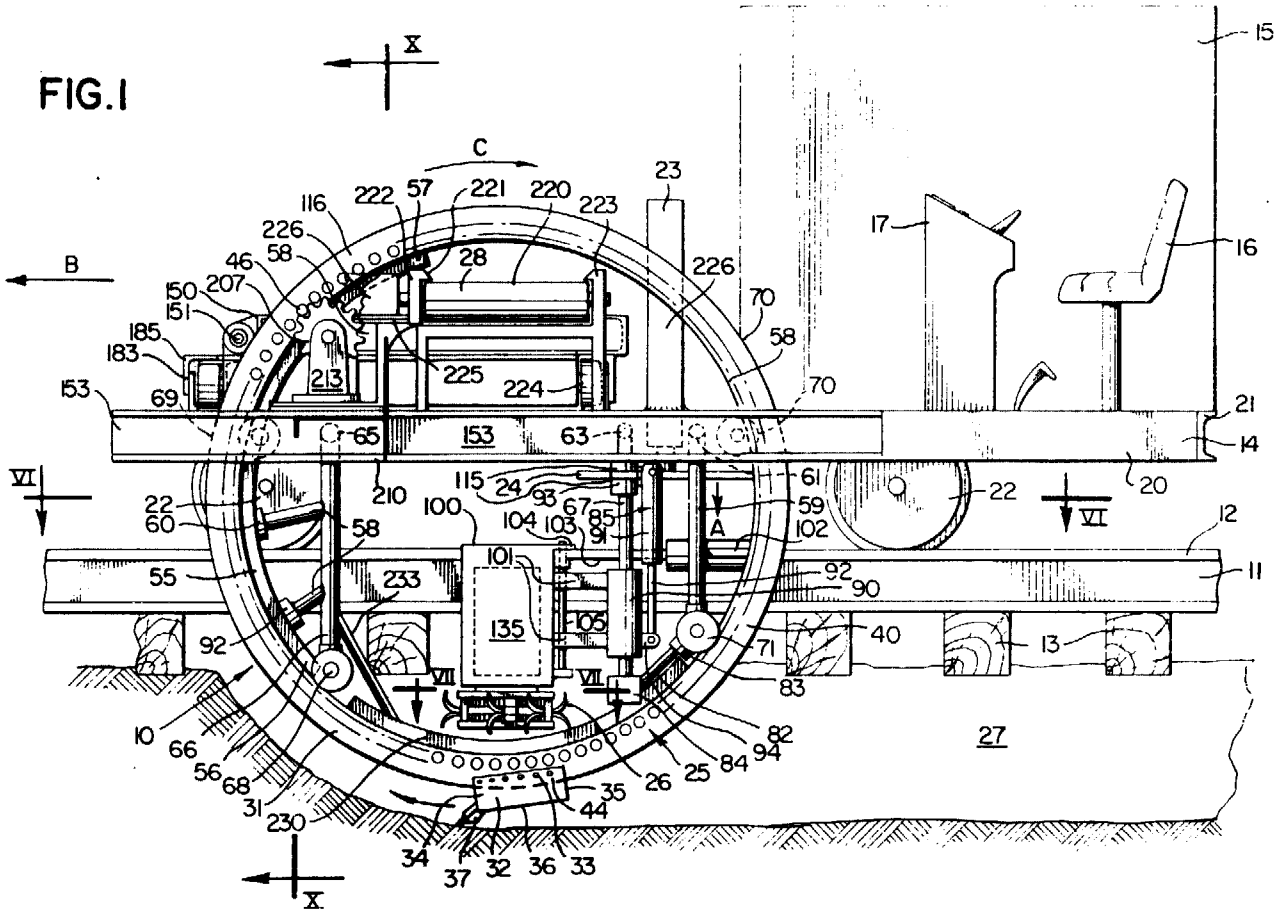
FIG. 1 is a side elevation of a preferred embodiment of the apparatus for removing material from beneath railroad tracks.

The apparatus 10 of the present invention removes material such as ballast, dirt, or debris from beneath a railroad track 11 consisting of rails 12 and wooden ties 13. The apparatus of the present invention is preferably mounted on a railroad car 14 which is powered by a motor in a motor housing 15. The car and apparatus can be operated by an operator sitting on a chair 16 in front of a control panel 17. The operator can operate both the apparatus 10 of the present invention and control the motion of the car 14 along the track with the use of the controls around the panel 17.

The railroad car 14 is built with a main frame having, for example, two longitudinally extending beams 20 extending along the two sides of the car and tow end beams 21 extending across each end of the car, the latter beams consisting of channel members in the embodiment shown in the drawings. The longitudinally extending beams 20 are mounted on two pairs of railroad wheels 22 and has a center jack 23 mounted in the center of the vehicle. The center jack 23 consists primarily of a large hydraulic jack extending in a vertical direction and a base plate 24 mounted at the bottom end of the jack. The base plate 24 can be lowered in the direction indicated by the arrow A to engage the roadbed between the rails 12 of the track and to lift the wheels 22 and apparatus 10 of the present invention clear of the track. This permits the railroad car 14 and apparatus 10 to be rotated any number of degrees about the center axis of the jack 23 which in turn allows the apparatus 10 of the present invention to operate on either side of the track. As will be explained in greater detail hereinafter, the illustrated track undercutter is arranged to remove ballast from beneath one-half of the track 11 during a first pass along the rails of the track. Once this half of the track has been rebuilt with new ballast, the car 14 is rotated 180° by means of the center jack 23 to place the apparatus 10 on the other side of the track. The ballast is then removed from the other half of the track. Since the center jack 23 is constructed in a well-known manner and such jacks are well known in the railroad building industry, further description of this jack is deemed to be unnecessary.

In lieu of this arrangement and to avoid the necessity of making two passes with the machine, the track undercutter 10 can be made of sufficient width and size to enable it to undercut the whole width of the track in a single pass. Primarily the length of the chain means described hereinafter would have to be increased. This latter arrangement would be advantageous around track switches and other obstructions.

The apparatus 10 of the present invention basically consists of a rotary trench digging means 25 and horizontal chain means 26 to transport the material from beneath the railroad track 11 and from the area between the ties 13 to the trench digging means 25 at an underground location. In operation, the trench digging means 25 digs a trench 27 alongside the track while at the same time transporting the ballast material delivered by the horizontal chain means 26 to a suitable location above the ground. During operation of the apparatus 10, the railroad car 14 moves in the direction indicated by the arrow B and the trench digging means 25 rotates about a horizontal axis extending perpendicular to the rails of the track in the direction indicated by the arrow C. The ballast, dirt, or other material removed by the trench digging means 25 can be deposited onto a belt conveyor 28 located near the top of the trench digging means, the top belt portion of which moves in the direction indicated by the arrow D, so that the ballast or other material is deposited either at the side of the roadbed or in a hopper of some form of transport vehicle. Alternatively the belt conveyor 28 can be constructed so that it can operate in two directions, either outwardly or inwardly where the ballast might for example be dropped into a cleaning apparatus to separate fines from still useable ballast. The cleaned ballast can then be returned to a position beneath the track.

Figure 2:
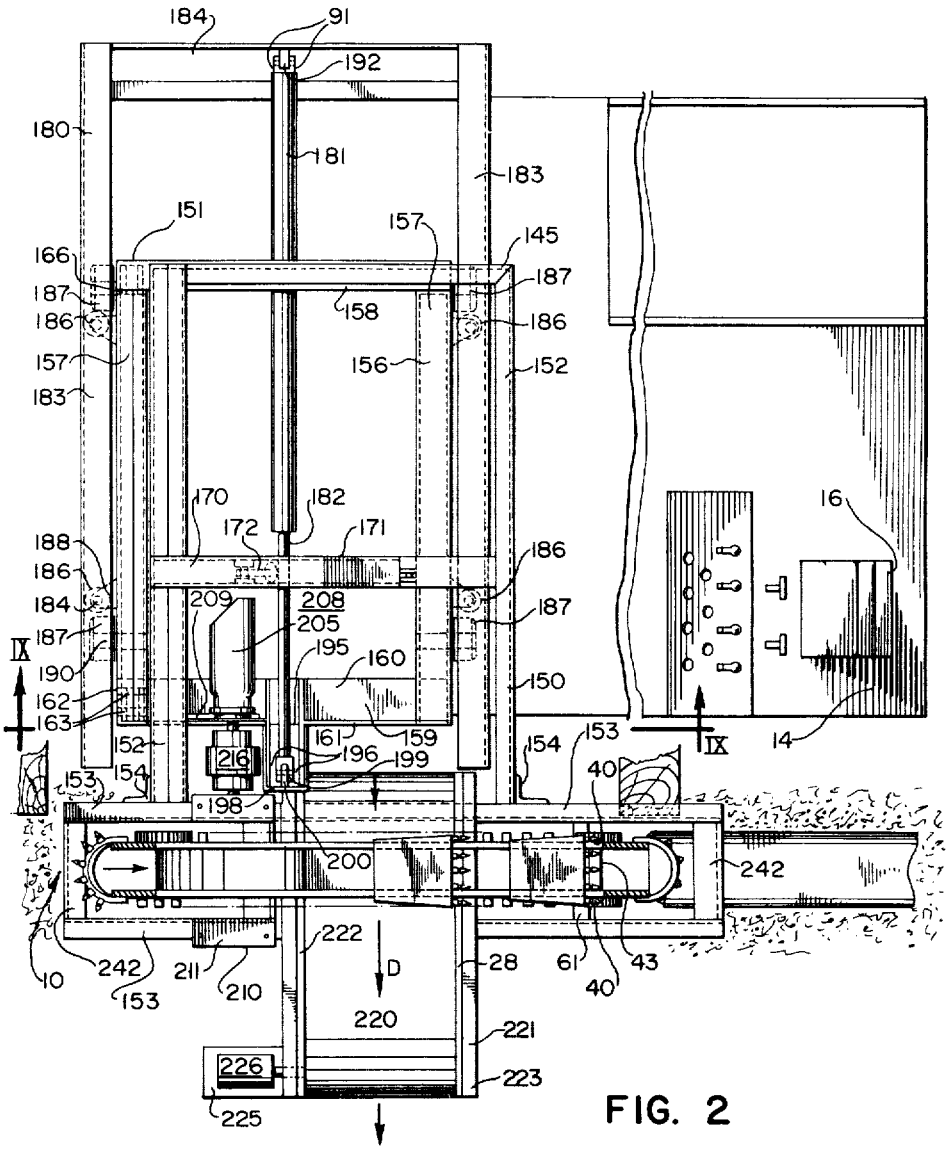
FIG. 2 is a plan view of the apparatus of FIG. 1.

The trench digging means 25 shown in FIGS. 1 and 2 comprises a large, hollow wheel 31 around which are arranged a number of digging buckets 32 rigidly connected to the outside of the wheel 31. The wheel 31 is rotatably mounted in an elongated rectangular frame consisting of two long channel members 153 extending from the front to the back of the wheel and two short channel members 242, one at each end of the member 153 and connecting the members 153 together. Each bucket 32 is formed with an open top 33 and an open front end 34 while the back 35 and bottom 36 of each bucket are closed. The front edge of the bottom 36 of each bucket is lined with a number of rock-digging teeth 37 of well-known construction. The wheel 31 is constructed with two large annular rims 40, each consisting of a large flat annular plate of uniform thickness. The two rims 40 are spaced apart a fixed distance which depends upon the width of the trench to be dug by the trench-digging means and are rigidly connected together via the digging buckets 32 distributed around the wheel.

Figure 5:
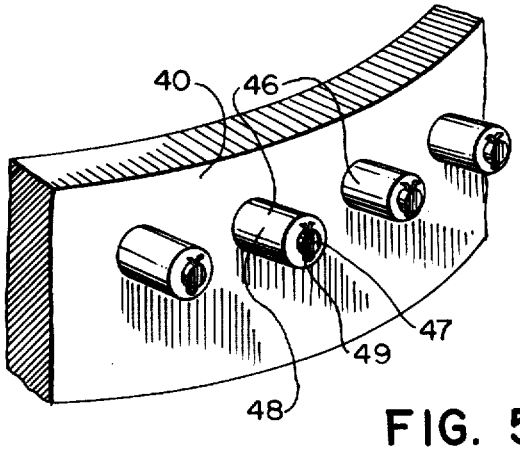
FIG. 5 is a perspective view of a preferred form of the drive lugs of the rotary trench digging means.

The digging buckets 32 are rigidly connected to the outside surface of each rim 40 preferably by means such as bolts or rivets 44. Projecting horizontally outwardly from the outer side of each rim 40 and located radially inwardly from the buckets are a series of lugs or projections 46 which extend completely around each of the rims. These lugs can be constructed in the manner shown in FIG. 5 of the drawings wherein there are shown two of the lugs 46 which have a round cross section. Each lug 46 has an inner cylindrical member 47 which is permanently attached to the rim. This cylindrical member could be formed integrally with the rim or could be welded thereto. Extending completely about the sides of the member 47 is a steel sleeve 48 which is free to rotate about the cylindrical member 47 and which fits snugly onto its respective member 47. Each sleeve 48 forms a wearing surfact for the lugs which can be replaced as the sleeve becomes worn. The sleeves 48 are fastened to the cylindrical member 47 by means of cotter pins 49. In order to replace the sleeve 48, the cotter pin 49 is simply removed and the old sleeve 48 is pulled off its cylindrical member 47. A new sleeve 48 is then placed over the cylindrical member and the cotter pin 49 is reattached to the member 47. In lieu of this arrangement, the lugs 46 can consist of simply welded protrusions or tits having no surrounding sleeves and having a non-circular cross-section adapted to fit the teeth of a drive sprocket.

In order to prevent ballast and other material in the digging buckets 32 from falling out of the buckets 32 prematurely as the buckets rotate upwards to the conveyor 28, the backing plate 55 is placed between the radially inner edges of the two rims 40 so that, as shown in FIG. 1, it extends from a location 56 located a short distance upwards and forwards from the bottom of the wheel 31 to a point 57 located just above the first side of the belt conveyor 28 encountered by the digging buckets 32. The backing plate 55 can be rigidly connected to one of the supporting frame members for the wheel 31 by means of support struts 58. In FIG. 1 of the drawings, each support strut 58 extends either from a wheel frame member 66 or from the channel members 153 to a transversely extending brace member 60. Each brace member 60 extends the complete width of the backing plate 55 to which it is rigidly connected and helps to strengthen the backing plate.

A lug guard 230 is positioned over the top of the lugs 46 at the bottom of the wheel 31. This guard prevents rocks or other ballast-type material which might fall accidentally from the top portion of the wheel 31 as it rotates from striking and possibly damaging or bending the lugs 46. The lug guard consists of two curved bars 231 (see FIG. 6) of rectangular cross-section rigidly connected together by cross bars 232. Each bar is positioned directly over one set of lugs 46 on either rim 40 and is rigidly mounted to the frame members on which the wheel 31 is rotatably mounted, such as frame member 66, by connecting strut 233.

Figure 3:
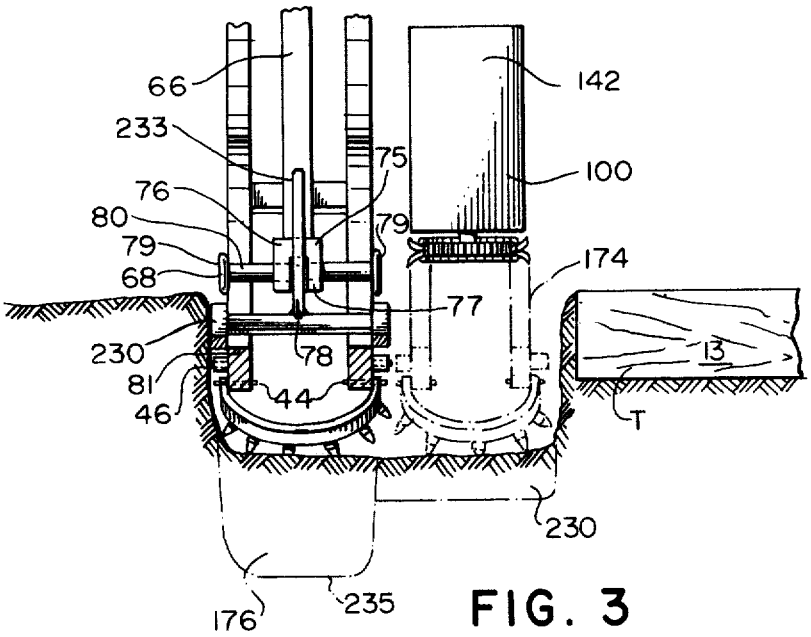
FIG. 3 is a sectional elevation along line III—III of FIG. 6 of the rotary trench digging means and the chain means just before insertion of the chain means in the trench formed by the former with the chain means in the position shown in dotted lines in FIG. 6.

The mounting for the wheel shown in FIG. 1 includes the channel members 153 extending parallel to the rails of the track, the aforementioned vertically extending, tubular frame member 66 and located at the front of the hollow center of the wheel 31, and a frame member 59. A further vertically extending tubular member 67 is located a relatively short distance in front of the frame member 59. Channel members 153 are connected to the upper end of frame member 66 by means of a short, horizontal tube 65 and are rigidly connected near their rear ends to the upper end of the frame member 59 by means of a horizontal tube 61. Four sets of rollers are distributed about the circumference of the wheel 31 at the radially inner edges of the two rims 40. The sets of rollers 68 and 71 are rotatably mounted on the aforementioned frame member 59 and 66 at the bottom end thereof. The manner in which these rollers are rotatably mounted on the frame members is best seen in FIG. 3 of the drawings wherein there is shown the means for connecting the set of rollers 68 to the bottom end of the frame member 66. A U-shaped bracket member 75 having a base portion 76 and two downwardly extending arms 77 is rigidly connected at its base portion 76 to the bottom end of number 66. A short shaft 78 extends through a hole formed in each of the arms 77 and is rigidly connected to each arm 77 in the hole. Preferably bearing means in the form of taper roller bearings are provided between the shaft 78 and each of two rollers 68 in order to prevent undue wear as each roller rotates on its end of the shaft. One of the rollers 68 is mounted on each end of shaft 78 with one side of each roller immediately adjacent to one of the arms 77. Each roller 68 has a radially extending flange 79 extending about its circumference at the outermost side of the roller. The cylindrical main body portion 80 of each roller 68 engages the radially inwardly facing cylindrical surface 81 of the adjacent rim 40 and is in rolling contact therewith. The rollers 71 are mounted in a similar manner as the set of rollers 68. It should be noted that the flanges 79 of the rollers are of course for the purpose of keeping the wheel 31 in its proper position on the rollers. In other words, the flanges 79 prevent the wheel 31 from shifting either to the left or to the right as seen in the view shown in FIG. 3.

Figure 10:
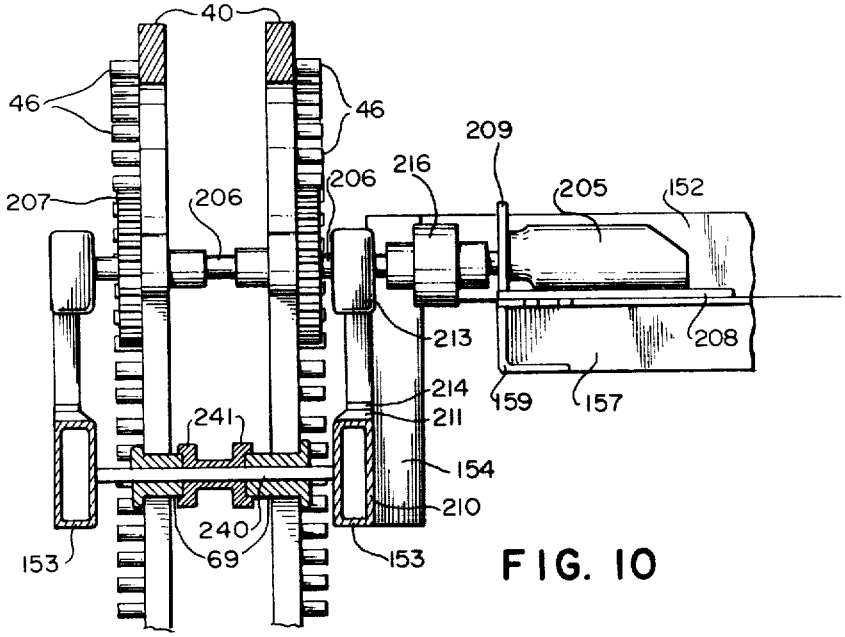
FIG. 10 is a sectional elevation generally along the line X—X of FIG. 1 showing the means for rotating the trench digging means of the present invention.

The method of mounting the two rollers 69 is shown in FIG. 10. A connecting bar 240 extends between the two channel members 153 a short distance radially inwards from the inner surface 81 of the two rims 40. To this bar 240 is rigidly connected a short non-rotating shaft by means of a U-shaped bracket having two radially outwardly extending legs 241 in which this shaft is mounted. The shaft extends parallel to the bar 240 and at each end thereof one of the rollers 69 is rotatably mounted. Again taper roller bearings are preferably arranged between the shaft and each roller. The two rollers 70 are mounted in a similar manner.

As best seen in FIG. 1, a short structural frame member 82 is rigidly connected to the front lower side of the bracket member of the rollers 71 by means of a further bracket member 83 which can be constructed in a manner similar to that of bracket member 75. Frame member 82 slopes at an angle down to a square joint member 84 to which the bottom end of frame member 82 is rigidly connected. Frame member 67 which can be a round solid bar or a tube is rigidly connected to the top side of joint member 84 and extends upwardly to a short, horizontal tubular connecting arm 63 to which the channel members 153 are rigidly connected.

The apparatus of the present invention is provided with means 85 for raising and lowering the horizontal chain means 26 relative to the trench digging means 25. Such means are necessary in order for the chain means 26 to be lowered into a trench dug by the trench-digging means 25. Without such raising and lowering means for the chain means, the chain means would prevent the initial trench digging operation by the trench digging means 25. The preferred means for raising or lowering the chain means of the present invention is shown in FIG. 1 and includes a cylindrical sleeve member 90, a hydraulic cylinder member 91, and a hydraulic piston member 92. Sleeve 90 extends about the frame member 67 and is free to slide up and down thereon. The closed top end of the cylinder 91 is pivotally connected to the upper end of frame member 67 by means of a pivoting bracket and sleeve 93 described in greater detail hereinafter. The bottom end of the piston member 92 is connected to a lug 94 which in turn in rigidly connected to the bottom end of sleeve member 90. Hydraulic hoses (not shown) are of course connected to the cylinder 91 and the piston 92 can thereby be moved up and down in the cylinder 91 in order to provide a corresponding vertical movement of the sleeve member 90.

Figure 6:
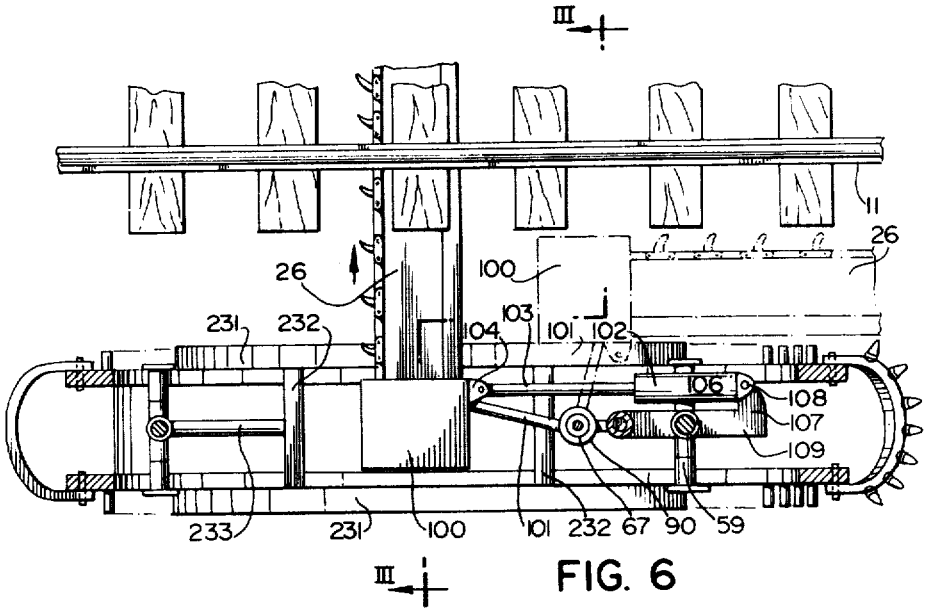
FIG. 6 is sectional plan view taken along line VI—VI of FIG. 1 showing the lower half of the rotary trench digging means and the chain means.

Means 95 must also be provided for pivoting the chain means 26 about a vertical axis in order that the chain means can be pivoted from a first position (shown in FIG. 3 and in dotted lines in FIG. 6) wherein the length of the chain means extends parallel to the track 11 to a second position (shown in FIG. 1 and in solid lines in FIG. 6) wherein the chain means 26 extends perpendicularly to the track. In other words, the chain means 26 of the present invention is capable of undergoing a pivotal movement of approximately 90° about a vertical axis defined by the frame member 67 in FIG. 1. The pivoting means 95 include a motor housing 100, connecting arms 101 for the housing 100, the previously mentioned sleeve member 90, and hydraulic cylinder means 102. The connecting arms 101 are rigidly connected at one end to the sleeve member 90 and at the other end to the housing 100 and they support the housing. The sleeve member 90 is free to pivot about its vertical axis. Turning now to FIG. 6 of the drawings, there is shown clearly the means of connecting the hydraulic cylinder means 102. The rod end of the piston 103 is pivotally connected to a corner of the motor housing 100. Two spaced apart connecting lugs 104, each having a similar hole therein, are rigidly connected to the top and bottom of the rear side of the housing when the housing is in the position shown in solid lines in FIG. 6. A vertical rod 105 is mounted in the two holes formed by the lugs 104 and slidably and pivotally connects the outer end of the piston member 103 to the two lugs. The closed rear end of the hydraulic cylinder 106 is pivotally connected to a short lug 107 by means of a short stub shaft 108. The lug 107 extends inwardly towards the track 11 from one side of a support arm 109 connected at one end to the wheel frame member 59. The support arm 109 extends in a horizontal plane when the wheel 31 is in the operating position. Hydraulic hoses (not shown) are attached to the cylinder 106 to provide a source of hydraulic fluid to move the piston member 103 into or out from the cylinder 106. The bracket member and sleeve 93 previously mentioned in connection with the hydraulic cylinder 91 are of course necessary in order to permit the cylinder 91 to swing about the longitudinal axis of the frame member 67 when the housing 100 and sleeve member 90 are swung from the position shown in solid lines in FIG. 6 to the position shown in dotted lines in FIG. 6. The bracket member extends radially outwardly from the sleeve 93 which comprises two, spaced apart ring member 115 which are rigidly connected to the bracket member. One of the ring members 115 is located on top of a rigid ring 64 extending about the periphery of frame member 67 and the other is located immediately below the ring 64. Each ring member 115 is rotatable on the frame member 67 and preferably bearing means are provided between each of the ring members 115 and the member 67 to permit the ring members to rotate easily. In lieu of the hydraulic cylinder means 102, it is obvious that some form of well known rotary actuator could be used instead to pivot the chain means about a vertical axis.

Figure 7:
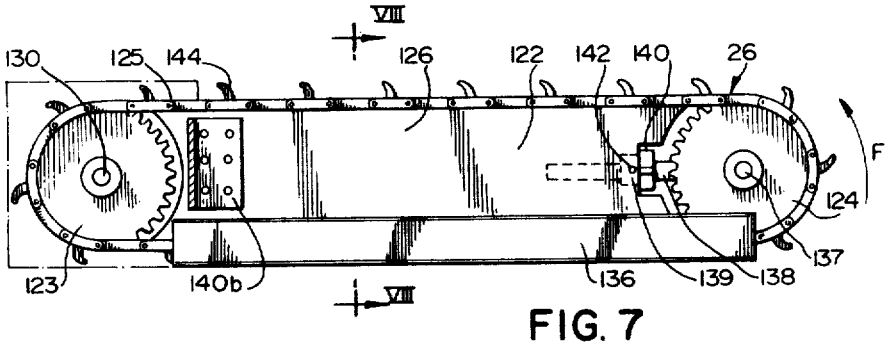
FIG. 7 is a plan view, partly in section along the line VII—VII of FIG. 1 of the horizontal chain means and support therefore.
Figure 8:
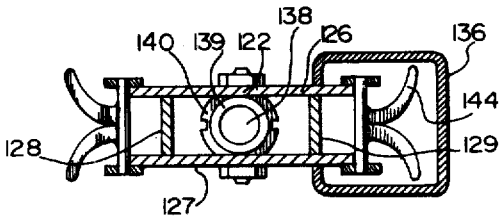
FIG. 8 is a sectional elevation of the chain means along the line VIII—VIII of FIG. 7.

The horizontal chain means 26 used with the apparatus of the present invention is generally constructed in a well-known manner except for the differences in construction explained hereinafter, particularly with respect to the means for mounting the chain means 26. Similar chain means are used for example in underground mining and particularly coal mining. One possible construction of the chain means is described and illustrated in the applicant's copending United States application Ser. No. 479,184 filed June 13, 1974. The chain means consists generally of a chain track 122, a drive sprocket 123, an idler sprocket 124 and a toothed-chain 125. The construction of the chain means 26 is best seen in FIGS. 7 and 8 of the drawings. The chain track 122 consists of elongated upper and lower plate members 126 and 127 which are spaced apart by two vertical support members 128 and 129. The vertical support members are located a short distance inwardly from the long sides of the two plate member 126 and 127. The drive sprocket is mounted directly on the hydraulic motor shaft 130 extending in a vertical direction from the bottom end of the motor housing 100. The motor housing 100 preferably contains a hydraulic motor 135 (schematically indicated in dotted lines in FIG. 1) made according to a well-known construction for driving the chain means via the motor shaft 130. A chain cover 136 can be rigidly attached to the rear long edge of the chain moving along the rear of a chain track from moving away ballast or any other material in the wrong direction, that is, away from the trench digging means 25. The idler sprocket 124 is preferably mounted on a short vertical axle 137 which is in turn rotatably mounted at the outer end of an externally threaded bar 138. The bar 138 is received in an internally threaded, rotatable sleeve 139 mounted between plate members 126 and 127. The sleeve 139 is connected to a nut 140 at the end closest to the sprocket, this nut being formed with notches for engagement with a suitable wrench. By rotating the nut 140 and sleeve 139, the bar 138 can be moved inwardly towards the chain track or outwardly, depending on the direction of rotation. Thus the amount of slack in the toothed chain can be properly adjusted. A set screw 142 can be mounted in the upper plate member 126 so that its bottom end engages the top of the sleeve 139. By tightening this set screw undesirably rotation of the sleeve 139 and the nut can be prevented. The idler sprocket 124 of course rotates in the direction indicated by the arrow F and is rotated by the movement of the toothed chain 125 in this direction.

The chain track 122 is rigidly connected to the bottom end of the motor housing 100 so that the chain means 26 will swing with the housing 100 when the housing 100 is swung in the above described manner by the hydraulic cylinder means 102. The means for connecting the train track 122 to the housing 100 can consist of a rigid horizontal plate **140*b*** which extends outwardly from the bottom of the housing and is riveted or bolted to the chain track. The toothed chain 125 has a number of scarifying teeth 144 distributed along its outside.

In order to transport the apparatus 10 of the present invention between job locations and in order to permit the rotary trench digging means 25 to dig the initial trench beside the track 11, it must of course be possible to raise or lower the wheel 31 and the associated apparatus. The present invention provides suitable means for carrying out this operation and these means include a rectangular frame (see FIG. 2) which is pivotal about a horizontal axis located at 151 and extending transversely to track 11. The frame 150 is rigidly connected to the inner channel member 153 so that the whole of the rotary trench digging means 25 and horizontal chain means 26 can be moved to a position completely above the track 11 by pivoting the frame 150 in a counterclockwise direction (as seen in the view of FIG. 1). The frame 150 consists of two relatively long, transversely extending members 152 and a relatively short channel member 145 which extends parallel to the rails 12. The rear member 152 is merely a forwardly open channel member while the front member 152 consists of two channel members welded together to form a member having a square cross-section. The inner channel member 153 is rigidly connected to the two members 152 by means of vertically extending, right angle connecting members 154 which can be bolted, riveted or welded to the adjacent portions of the channel members. Thus the channel members 153 are positioned a short distance beneath the frame 150. The frame members 66 and 59 are connected to the channel members 153 by means of the two, short, connecting members 61 and 65 which extend horizontally between the channel members 153.

It must first of all be noted that, instead of pivoting the frame 150 in order to raise or lower the wheel 131, as shown and described herein, it is obvious to one skilled in the art that the frame 150 or similar structure and thus the wheel could simply be raised and lowered vertically in a straight line. Such an arrangement is not shown or described in the present application as it is deemed not to be necessary because of its obviousness. A number of hydraulic jacks could of course be employed to do this.

Figure 9:
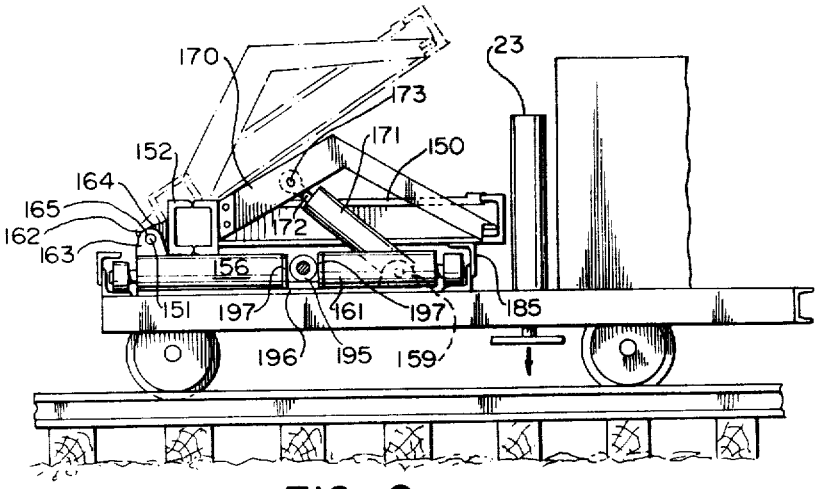
FIG. 9 is a sectional elevation along the line IX—IX of FIG. 2 showing the manner in which the lift means for the apparatus of the present invention is constructed.

The frame 150 is pivotally mounted on a horizontally movable horizontal frame 156. The manner in which the frame 150 is connected to the horizontal frame 156 is best seen in FIGS. 2 and 9. The frame member 156 is constructed in a manner similar to that of frame 150, that is, with two, relatively long, transversely extending members 157 and a relatively short channel member 158 extending in the direction of the tracks 11 and located at the ends of the members 157 furthest from the wheel 31. The members 157 are also each constructed from two channel members welded together to form a member with a square cross-section. However, unlike the frame 150, the frame 156 has the ends of the members 157 closest to the wheel 31 connected by a right angle member 159 which extends in a direction parallel to the track 11. The right angle member 159 has a horizontal portion 160 and a vertical portion 161. Mounted near the front end of member 159 and extending upwardly from the top surface of the end of the front member 157 is a U-shaped bracket member 162. The two upwardly extending arms 163 of member 162 are spaced apart a short distance and have similar holes therein. A lug 164 extends forwardly from the front surface of the front member 152 and is rigidly connected to this frong surface. The lug 164 is positioned between the two arms 163 and a short connecting shaft 165 pivotally connects the lug 164 to the two arms. Similarly, a U-shaped bracket member 166 extends upwardly from the top of the front member 157 near the front end of the chamber member 158. This bracket member is also pivotally connected to a lug which is rigidly connected to the front surface of the front member 152.

The apparatus shown in the drawings, as mentioned, has means for pivoting the frame 150 with respect to the horizontal frame 156. The preferred means shown in the drawings consists of a pivoting arm 170, a pivoting hydraulic cylinder 171, and a hydraulic piston member 172 which can slide in or out of the cylinder 171. The pivoting arm 170 can consist of a longitudinally bent tubular member having a rectangular cross section, the front end of which is rigidly connected to the front member 152 of the frame 150 and the rear end of which is rigidly connected to the rear member 152. The front portion of the arm 170 can be arranged at an angle such as that shown in FIG. 9 so that the front portion slopes upwardly in the rearward direction when the frame 150 is disposed in a horizontal plane. In this position, the hydraulic cylinder 171 and its piston member are also arranged at an angle to the horizontal so that they slope upwardly in the forward direction. The closed bottom end of cylinder 171 is connected to the rear member 157 of frame 156 so that it is free to pivot about a horizontal axis. The upper end of the piston member 172 is pivotally connected to the front portion of arm 170 by means of a short shaft 173. The bottom surface of the front portion of arm 170 is partly open to receive the upper end of piston member 172. Hydraulic hoses (not shown) are of course connected to the cylinder 171 to supply hydraulic fluid thereto. It will be readily seen that outward movement of the piston member 172 relative to the cylinder 171 will cause the arm 170 and the frame 150 connected thereto to be swung in an upward direction to a position such as that shown in dotted lines in FIG. 9. The position shown in dotted lines in FIG. 9 will hereinafter be termed the upper position of the apparatus of the present invention. In this position the rotary trencher is located sufficiently above the railroad tracks to permit the vehicle on which it is mounted to travel between job locations.

With the preferred embodiment of the present invention shown in the drawings, means are also provided to move the wheel 31 and the chain means in the direction transverse to the rails of the track. When the wheel 31 is brought to the upper position, the wheel and associated apparatus can be brought inwardly to the position within the track profile in order to permit movement of the apparatus through track tunnels and over track bridges or on trailers on highways. When the car 14 reaches the job site location, the rotary trench-digging means 25 is then slid outwardly to a position above that shown in dotted lines in FIG. 3 and indicated by the numeral 174. The wheel 31 is then rotated to begin the digging operation and to dig a trench immediately beside the adjacent end of the railroad ties 13. Eventually, the rotary trench digging means 25 is brought out to the position shown in solid lines in FIG. 3 where a deeper trench 176 is dug. Thus, means must be provided for moving the wheel 31 transversely from a position within the track profile to the outermost position of the wheel 31 shown in FIG. 3. The preferred means for moving the apparatus 10 in this manner consists of the aforementioned frame 156, a rigid non-moving U-shaped frame 180, a hydraulic cylinder 181 and a hydraulic piston member 182 mounted to slide in the cylinder 181. The U-shaped frame 180 consists of two relatively long, transversely extending roller track members 183 and interconnecting right-angle frame member 184 located at the ends of members 183 furthest from the wheel 31 and extending parallel to the rails of the track. Each roller track member 183 comprises two right-angle structural members 185 which can either be welded or bolted together. The two structural members 185 are connected together so as to form a U-shaped channel open in the direction of the other roller track member 183. The frame 156 is generally completely enclosed by the U-shaped frame 180 with each member 157 located just slightly in from one of the track members 183. The frame 156 is mounted on rollers in the frame 180, these rollers consisting of four small rollers 186 mounted to rotate about vertical axes and four larger rollers 187 mounted to rotate about horizontal axes. Each of these rollers is shown in dotted lines in FIG. 2 of the drawings. Each roller 186 is mounted on a U-shaped bracket 188, the two arms of which project horizontally and outwardly from the outer side of the member 157. A short axle 189 is rigidly mounted at each end in holes formed in arms of bracket 188 and the roller 186 is rotatably mounted on this shaft. The peripheral surface of each roller 186 engages the inside surface of the vertical portion of each roller track member 183. Each larger roller 187 is rotatably mounted on a shaft 190 which is rigidly mounted in one of the frame members 157 and which extends outwardly from the side of the member 157 adjacent to the roller track 183. The peripheral surface of each roller 187 engages the inner surfaces of the horizontal portions of each respective track member 183, and preferably each roller 187 fits snugly, but not tightly, between the upper and lower horizontal portions of the track member so as to prevent undue play between the rollers and the track member.

Hydraulic cylinder 181 is located midway between track members 183 and parallel thereto. The closed end of the cylinder is conected to the middle of frame member 184 by means of two lugs 91 rigidly connected to the rear end of the cylinder. A further lug 192 is rigidly connected to frame member 184 and extends between the two lugs 91 with a snug fit. A pin member connects lug 192 to the two lugs 91. The outer end of the piston member 182 is connected to the center of the right angle member 159 of frame 156. Preferably, a center section 195 of vertical portion 161 is cut away to form a rectangular opening (see FIG. 9). A horizontal extension 196 is mounted to the outer edge of the horizontal portion 160. Two vertical wall members 197 are rigidly attached to the top side of the side edges of the extension 196 and to the top of horizontal portion 160 to form a transversely extending, open-topped channel.

A rectangular end plate 198 is welded to the outer end of this U-shaped channel so as to close the outer end. The outer end of the piston member 182 has a U-shaped bracket 199 and a lug 200, which is rigidly connected to the end plate 198, extends between the two arms of the bracket 199. This lug 200 is connected to the two arms of the bracket by means of a pin member. Thus, it will be readily seen that outward movement of the piston member 182 from the cylinder 181 under the force of hydraulic fluid will cause the frame 156 to move outwardly on its rollers to a position such as that shown in FIG. 2. This will of course cause a corresponding outward movement of the wheel 31 and the chain means 26.

Power means must of course be provided for rotating the wheel 31 about it horizontal axis and preferably such means consists of a hydraulic motor 205, a drive shaft 206, and a pair of drive sprockets 207 (only one of which can be seen in FIG. 1). The motor 205 is rigidly mounted to the pivotal frame 150 on a platform 208 which is attached to the rear of the square frame member 152. Thus the plate member 208 with the motor 205 pivots upward from a horizontal position shown in FIG. 2 when the frame 150 is pivoted upwardly. The end of the motor closest to wheel 31 is protected by and mounted in a vertical plate member 209 which extends upwardly from the platform 208 and is rigidly connected thereto.

Turning now to FIG. 10 of the drawings, there is shown the means for mounting the drive sprockets 207 and the means for connecting the drive sprockets to the hydraulic motor 205. Each of the two channel members 153 on which the wheel 31 is mounted has a vertical plate 210 mounted to its exterior and extending from one horizontally extending arm of each channel member 153 to the other arm thereof. Rigidly attached to the upper edge of each plate member 210 is a horizontal steel plate 211 extending the length of the plate member 210. The steel plate 211 is also rigidly connected to the top surface of the adjacent channel member 153 such as by welding. A pillow block 213 is mounted on top of each of the steel plates 211 by means of an interconnecting base plate 214 of the pillow block. Each base plate 214 is rigidly connected to the steel plate 211 such as by bolts or studs. Each pillow block 213 contains suitable bearing means for the drive shaft 206 which extends through the two drive sprockets and two pillow blocks 213. The drive shaft 206 is preferably connected to the motor 205 by means of a flexible coupling 216 in order to avoid the need for precision machining of the parts.

The manner in which the teeth of each drive sprocket 207 engages the round lugs 46 is best shown in FIG. 1 of the drawings. It is obvious that rotation of the two sprockets 207 will cause the wheel 31 to rotate on the rollers 68 to 71.

As explained earlier, the apparatus of the present invention is preferably fitted with the belt conveyor 28 to remove the material falling from the digging buckets 32 as they reach the top of the wheel 31 to a suitable location such as beside the track. The suitable location could be an area or device where the ballast brought up is cleaned to remove fines and dirt. The cleaning device could be located on the undercutting vehicle shown or could be attached and mounted on a separate vehicle. The construction of the best conveyor will now be described with particular reference to FIGS. 1 and 2 of the drawings. The best conveyor preferably has a moving endless rubber belt 220 which is mounted on cylindrical rollers which in turn are rotatably mounted on a support frame 221. This support frame 221 comprises two side frame 222 and 223 and interconnecting frame 224 for connecting the support frame to the inner channel member 153. Each side frame 222 and 223 extends along the entire length of the rubber belt 220 and extends upwardly from the top side edge of the belt to prevent material from falling from the sides of the conveyor. The interconnecting frame 224 has vertical legs which extend downwardly from the conveyor to the top of the channel members 153. The bottom of the legs 224 can be mounted in such a way as to be detachable from the channel members 153 in order that the conveyor mechanism can be removed from the position shown to a position within the track profile for travel between jobs. Mounted at the outer end of the side frame 222 is a platform 225 on which a motor for the conveyor can be mounted. The motor 226 again is preferably a hydraulic motor and this motor drives one of the rollers on which the rubber belt 220 is mounted, preferably the outer end roller.

The operation of the apparatus 10 of the present invention will now be described in detail. The transport position of the apparatus, the chain means 26 and the trench digging means are located as close as possible to the railroad car 14 and are within the track profile. Preferably the chain means 26 and the trench digging means rest on suitable support pads (not shown) during travel, these pads helping to absorb bumps and vibrations encountered at this time. The chain means can be brought to a position perpendicular to the rails of the track to permit such pads to be used. When the car 14 arrives at the location where the undercutting operation is to take place, the chain means 26 is brought to the position shown in dotted lines in FIG. 6. In other words, the chain means will extend in the direction parallel to the rails 12 of the track and will be located adjacent to inner side of wheel 31. The chain means 26 will also be raised to its uppermost position relative to the wheel 31 (see the chain means illustrated in solid lines in FIG. 3).

The wheel 31 is moved to a position just out from the ends of the ties of the track by moving the frame 156 with the hydraulic cylinder and piston member 181 and 182. Rotary movement of the wheel 31 is then started and maintained by the motor 205 with the wheel rotating always in the direction indicated by the arrow C of FIG. 1. The wheel 31 is then gradually lowered as the initial trench is dug to the position of the wheel indicated in dotted lines in FIG. 3. This lowering operation is accomplished by pivoting the frame 150 downwards by means of the hydraulic cylinder and piston member 171 and 172. Alternatively and as discussed hereinbefore, the frame 150 can be arranged to move vertically up and down in a straight line. This initial trench is dug to whatever depth is required for the chain means 26. In many cases, the chain means 26 need only be inserted immediately beneath the ties of the track but, if a greater depth of undercutting is desired, a deeper initial trench 230 (shown in dotted lines in FIG. 3) can be dug for the chain means 26. During this trench digging operation, the chain means 26 will be located above the railroad track and will not interfere with the initial trench digging operation.

Once the initial trench has been dug, one or more further trenches are dug out from the initial trench in order to form one large trench having a width at least as great as that shown in FIG. 3. In other words, a trench is constructed with the rotary trench digging means 25 which is wide enough to permit the insertion of both the trench digging means 25 and the chain means 26 while the latter is in the position shown in dotted lines in FIG. 6, that is, adjacent the inner side of wheel 31.

Once this wide trench has been completed, the trench digging means 25 is employed to dig an even deeper trench 235 shown in dotted lines in FIG. 3. This deeper trench 235 is located along the side of the large trench farthest from the adjacent ends of the ties 13 and is just wide enough to accommodate the trench digging means 25. This deeper trench 235 must be deep enough to permit the chain means 26 to be pivoted from the position shown in dotted lines in FIG. 6 to the position shown in solid lines after the chain means 126 has been lowered to the desired position beneath the ties in the large trench. The next step in the operation after the trench 235 has been formed is to lower the chain means 26 to the bottom of the trench by means of the hydraulic cylinder 91 and piston member 92.

Operation of the toothed chain of the chain means 26 is commenced and maintained so that the toothed chain moves about the chain track 122 with power supplied by the hydraulic motor in housing 100. Once the chain begins to move, the housing 100 and the chain means 26 connected thereto are pivoted from the position shown in dotted lines in FIG. 6 to the position shown in solid lines in FIG. 6. This pivoting operation must take place gradually of course to enable the chain means to remove the ballast and other material in front of it as it moves beneath the ties. This 90° pivotal movement is accomplished with the use of hydraulic cylinder 106 and the piston member mounted therein or a suitable rotary actuator. When the chain means 26 has been brought to a position parallel to the ties, the drive sprocket 123, the housing 100 and the means for pivoting the housing are all located within the interior of the rotary trench digging means 25. It will be readily seen that the chain means in this position will deposit ballast in the digging buckets 32 as they pass beneath the drive sprocket 123.

Figure 4:
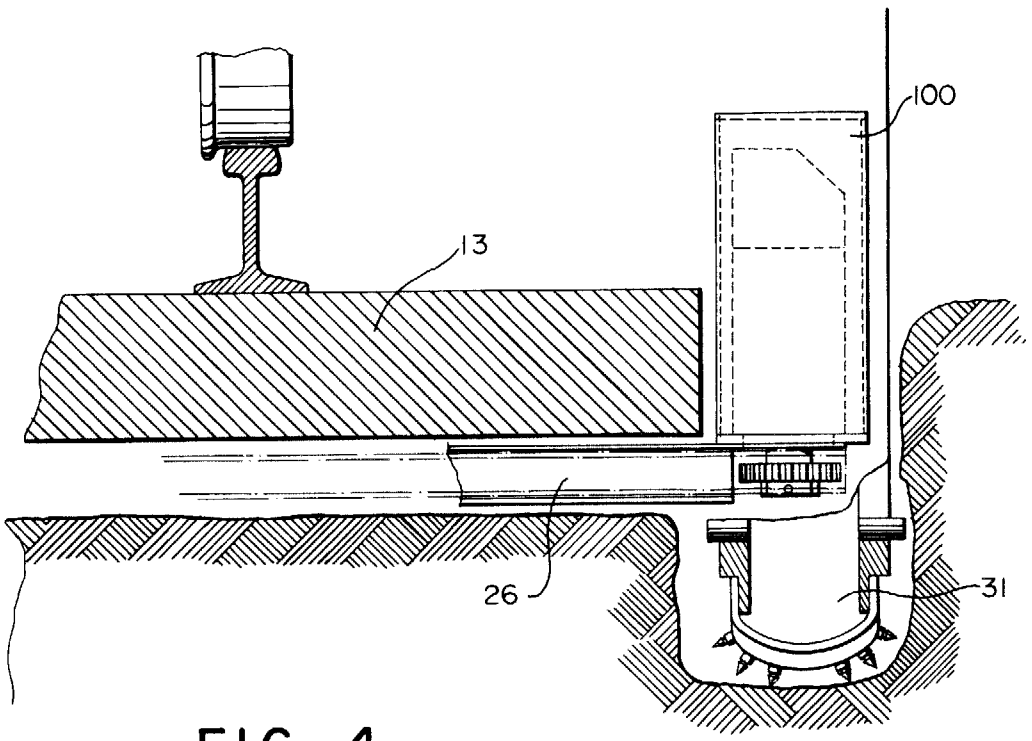
FIG. 4 is a view similar to that of FIG. 3 but with the chain means lowered into the trench and pivoted to a position perpendicular to the rails of the track.

The next step is to bring the wheel 31 and chain means 26 to the position shown schematically in FIG. 4 of the drawings wherein the wheel 31 is located immediately adjacent to the ends of ties 13. This change in position is accomplished by means of the horizontally movable frame 156 and the hydraulic cylinder and piston member 181 and 182. As the wheel 31 and chain means 26 are gradually drawn towards the ends of the ties, the teeth of the members gradually work themselves into the railroad bed, removing the material blocking their movement towards the track. This latter step of bringing the rotary trench digging means to a position adjacent to the ties is necessary in order to avoid digging an unnecessarily wide trench beside the ties. Thus, during normal operation of the machine, only a trench as wide as the buckets 32 is dug alongside the railroad ties.

Once the chain means 26 and trench digging means 25 have been brought to the position shown in FIG. 4, the whole of the apparatus 10 is gradually moved forward along the track in the direction indicated by the arrow B by means of the self-propelled car 14. The speed of the movement of the car 14 along the track 11 of course depends on the rate at which the apparatus 10 is able to move the ballast from beneath one-half of the track and the speed may also depend on the rate at which new ballast can be supplied behind the car 14. Once one side of the length of track to be undercut has been cleared of ballast by the apparatus 10, the trench digging means 25 and chain means 26 are removed from beneath the track 11 to a position above the rails. This is accomplished obviously by reversing the operation hereinbefore described for placing the trench digging means 25 and horizontal chain means in the position shown in FIG. 4. The apparatus 10 and car 14 are then lifted from track 11 by means of the center jack 23 so that they are completely above the rails 12 of the track. The car 14 is then rotated 180° about the vertical axis formed by the centre jack to place the apparatus 10 on the other side of the track. The other half of the track is then undercut in the same manner as the first half.

Tamping heads of known construction (not shown) can be included in the present undercutting machine at the back of the vehicle. These heads tamp new ballast as it is inserted under the track and between the ties. In this way the amount of track which is not supported at any one time is no longer than the length of the vehicle.

In lieu of the arrangement shown and described, it will be recognized that the car 14 could be provided with two of the apparatuses 10 or, in other words, two rotary trench digging means 10 each having a horizontal chain means 266. In this construction, the need for the center jack 23 is eliminated as one of the apparatus 10 is arranged on each side of the track. Thus the whole of the underside of the track can be undercut at once and there is no need to make two passes with the machine, except perhaps in the area of a switch or other obstructions.

In addition to the ballast cleaner, already referred to, the apparatus 10 of the present invention could also be used in combination with one or more known pieces of machinery such as ballast tamping units, rail and tie lifting and lining devices, storage hoppers for the new ballast to be laid, and finally devices for distributing and depositing new ballast. Such equipment can either be mounted on the same railway car 14 or on adjoining cars. In one particular embodiment, a tamping device of known construction is mounted on a framework on the rear of the car 14 in such a manner that its tool heads can be lowered into the ballast when in use or raised to a position within the track profile for travelling between jobs.

If the fines and other waste material in the old ballast are removed by a cleaning device and then the cleaned ballast used again for the roadbed, new ballast from a center or other hopper can be mixed with the cleaned ballast to replace the unwanted material removed. Once the new or cleaned ballast has been deposited beneath the track, the tamping tool heads at the rear are moved ahead to the new ballast. In a known manner, the motion of the car stops momentarily at short intervals along the track to permit the tamping operation to take place. If there are two of the apparatuses, one on each side, then two tamping units can also be used.

What I claim as my invention is:

1. An apparatus for removing material from beneath railroad track comprising a rotary trench digging means having digging buckets arranged to circulate about an open space in the interior of said trench digging means, so as to dig a trench beside said track when in their lowest position and discharge to a receiving means when they are near their highest position, and horizontally extending, elongated chain digging means to dig and transport said material horizontally, said chain digging means during normal operation extending underneath said track and having one end located adjacent the bottom of said trench digging means and within said open space in the interior of said trench digging means, wherein said material is transported by said chain digging means from beneath said railroad track to said trench digging means at a point below ground level and beside said railroad track and drops by force of gravity into said digging buckets as said buckets pass beneath said one end of said chain digging means, said trench digging means serving to dig said trench alongside of said track while at the same time transporting the material delivered by said chain digging means to said receiving means, said receiving means being above the ground level.

2. An apparatus for removing material from beneath railroad track according to claim 1 including means for pivoting said chain digging means about a vertical axis whereby said chain digging means can be pivoted from a first position wherein said elongated chain digging means extends parallel to the longitudinal direction of the rails of said track to a second position wherein said chain digging means extends substantially perpendicular to the longitudinal direction of the rails of said track.

3. An apparatus for removing material from beneath railroad track according to claim 2 wherein said chain digging means is disposed outside of the interior said trench digging means in said first position and said one end of said chain digging means is disposed in the interior of said trench digging means in said second position.

4. An apparatus for removing material from beneath railroad track according to claim 3 including a housing having a bottom end and containing motor means for driving said chain digging means and wherein said chain digging means is supported at the bottom end of said housing, said housing being swingable about said vertical axis in order to pivot said chain digging means about said vertical axis.

5. An apparatus for removing material from beneath railroad track according to claim 4 including means for raising and lowering said chain digging means and said housing up or down with respect to said trench digging means to permit said chain digging means to be lowered from a position above the ground level to a position beneath the level of said railroad track while the bottom of said trench digging means is disposed beneath the ground.

6. An apparatus for removing material from beneath railroad track according to claim 5 wherein said raising and lowering means includes a sleeve slidingly mounted on a generally vertical frame member, a first hydraulic cylinder member extending alongside said frame member and pivotally connected thereto, and a first piston member slidingly mounted in said cylinder member and connected at its outer end to said sleeve, said sleeve being rigidly connected to said housing by means of horizontally-extending arms.

7. An apparatus for removing material from beneath railroad track according to claim 5 including means for raising and lowering said trench digging means whereby the bottom of said trench digging means is movable from a primary position beneath the level of said railroad track to a secondary position above the level of said track.

8. An apparatus for removing material from beneath railroad track according to claim 7 wherein said raising and lowering means for said trench digging means includes a rectangular frame which is pivotable about a horizontal axis located along one side of said rectangular frame and extending transversely to the longitudinal direction of said track, a second hydraulic cylinder pivotably mounted to a support on said apparatus at a closed end of said second cylinder, a second piston member slidingly mounted in said second cylinder and pivotably connected at the end thereof furthest from said second cylinder to said rectangular frame, wherein outward movement of said second piston member relative to said second cylinder pivots said rectangular frame and raises said trench digging means which is rigidly connected to one end of said rectangular frame and inward movement of said second piston member lowers said trench digging means.

9. An apparatus for removing material from beneath railroad track according to claim 8 including a vehicle capable of travelling over said track, a horizontal frame mounted for horizontal movement on said vehicle in a direction perpendicular to the length of said track and means for horizontally moving said horizontal frame, wherein said rectangular frame is pivotally mounted to said horizontal frame and is located on top thereof, said second hydraulic cylinder is pivotably mounted to said horizontal frame which forms said support, said horizontal frame and moving means provide means for shifting said trench digging means from a position directly above said railroad track for transporting the apparatus between job locations to a position located outwardly from the adjacent ends of the ties of said track where the bottom of said trench digging means can be moved to said primary position to dig said trench.

10. An apparatus for removing material from beneath railroad track according to claim 7 including means for shifting said trench digging means horizontally and transversely relative to the longitudinal direction of said track from a position directly above said railroad track for transporting said apparatus between job locations to a position located outwardly from the adjacent ends of the ties of said track where the bottom of said trench digging means can be moved to said primary position to dig said trench.

11. An apparatus for removing material from beneath railroad track according to claim 7 wherein said trench digging means includes a large hollow wheel arranged to rotate about a horizontal axis, said digging buckets being arranged about the circumference of said wheel, including means for rotating said hollow wheel about a horizontal centre axis located at the centre of said wheel, said rotating means including lug means consisting of a nuber of lugs arranged at regular intervals about the circumference of and at the sides of said hollow wheel, sprocket means to engage said lug means, and motor means for rotating said sprocket means, whereby rotation of said sprocket means rotates said hollow wheel.

12. An apparatus for removing material from beneath railroad track according to claim 11 wherein said hollow wheel includes two horizontally spaced-apart rims with said digging buckets distributed about the circumference of said hollow wheel, each bucket having two parallel upper edges each of which is rigidly connected to one of said rims, and said receiving means including a horizontal conveyor extending transversely to the longitudinal direction of said track, one end of said conveyor being located within said hollow wheel near the top thereof for transporting material falling from said buckets to a suitable location.

13. An apparatus for removing material from beneath railroad track according to claim 2 wherein said pivoting means are located in the interior of said trench digging means when said chain digging means is in said second position.

14. An apparatus for removing material from beneath railroad track according to claim 13 wherein said pivot means includes a housing having a bottom end and containing motor means for driving the chain digging means, said housing being swingable about said vertical axis, said chain digging means being supported at the bottom end of said housing.

15. An apparatus for removing material from beneath railroad track according to claim 1 wherein said trench digging means includes a large hollow wheel arranged to rotate about a horizontal axis, said digging buckets being arranged about the circumference of said wheel, including means for rotating said hollow wheel about a horizontal axis located at the centre of said wheel, said rotating means including lug means consisting of a number of lugs arranged at regular intervals about the circumference of and at the sides of said hollow wheel, sprocket means to engage said lug means, and motor means for rotating said sprocket means, whereby rotation of said sprocket means rotates said hollow wheel.

16. An apparatus for removing material from beneath railroad track according to claim 15 wherein said lugs comprise a number of horizontally extending cylindrical lugs projecting outwardly from the sides of said hollow wheel.

17. An apparatus for removing material from beneath railroad track according to claim 16 wherein each of said lugs comprises an inner cylindrical member permanently attached to the side of said hollow wheel and a coaxial replaceable sleeve surrounding said cylindrical member and forming a wearing surface for the lug, said sleeve being free to rotate about the centre axis of said cylindrical member.

18. A method for removing material from beneath railroad track comprising initially digging a trench along one side of said track with rotary trench digging means disposed in a vertical plane and having digging buckets arranged to circulate about an open space lowering horizontal chain digging means into said trench, said chain digging means extending in a direction parallel to said track, swinging said chain digging means about a vertical axis to an operating position substantially perpendicular to the longitudinal direction of said track and beneath said track and locating one end of said chain digging means above the bottom of and in the interior of said trench digging means, digging and removing said material from beneath said track with said chain digging means, said chain digging means delivering said material to said buckets as they approach the bottom of said trench digging means where said material drops by force of gravity into said buckets of said trench digging means, and transporting the material dug by said chain digging means and by said trench digging means in said buckets to an unloading position above ground level.

19. A method for removing material from beneath railroad track according to claim 18 wherein said trench is dug wide enough to accomodate both said trench digging means and said chain digging means extending in a direction parallel to the longitudinal direction of said track and said chain digging means is lowered into said trench beside said trench digging means.

20. A method for removing material from beneath railroad track according to claim 19 wherein said trench is dug deeper by said trench digging means in a section of the trench furthest from said track, said section having a width equal to that of the trench digging means, and said bottom of said trench digging means is lowered to the bottom of said deeper section before said chain digging means is swung to said operating position.

21. A method for removing material from beneath railroad track according to claim 20 wherein said chain digging and trench digging means are moved horizontally toward said track after said chain digging means is swung to said operating position until said trench digging means is as close as possible to said track.

* * * * *